US010052539B1

(12) United States Patent
Chou et al.

(10) Patent No.: US 10,052,539 B1
(45) Date of Patent: Aug. 21, 2018

(54) GOLF CLUB HEAD

(71) Applicant: Advanced International Multitech Co., Ltd., Kaohsiung (TW)

(72) Inventors: I-Nan Chou, Kaoshiung (TW); Te-Fu Hsiao, Kaohsiung (TW); Yu-Jui Pan, Kaohsiung (TW); Chin-Tang Chang, Kaohsiung (TW)

(73) Assignee: Advanced International Multitech Co., Ltd., Kaohsiung (TW)

( * ) Notice: Subject to any disclaimer, the term of this patent is extended or adjusted under 35 U.S.C. 154(b) by 0 days.

(21) Appl. No.: 15/730,192

(22) Filed: Oct. 11, 2017

(30) Foreign Application Priority Data

Jul. 28, 2017 (TW) ..... 106125443 A

(51) Int. Cl.
*A63B 43/00* (2006.01)
*A63B 53/04* (2015.01)
*A63B 60/46* (2015.01)

(52) U.S. Cl.
CPC ..... *A63B 60/46* (2015.10); *A63B 53/04* (2013.01); *A63B 43/004* (2013.01); *A63B 2053/0491* (2013.01)

(58) Field of Classification Search
CPC . A63B 60/46; A63B 53/04; A63B 2053/0491; A63B 43/004
See application file for complete search history.

(56) References Cited

U.S. PATENT DOCUMENTS

| | | | | |
|---|---|---|---|---|
| 8,668,595 | B2 * | 3/2014 | Boyd | A63B 24/0003 473/223 |
| 8,951,145 | B2 * | 2/2015 | Bezilla | A63B 53/0466 473/334 |
| 2006/0178229 | A1 * | 8/2006 | Liang | A63B 53/0466 473/334 |
| 2009/0131200 | A1 * | 5/2009 | Akinori | A63B 53/0466 473/337 |
| 2013/0065703 | A1 * | 3/2013 | Rose | A63B 69/3632 473/223 |
| 2015/0157900 | A1 * | 6/2015 | Holthouse | A63B 24/0021 473/570 |
| 2016/0184631 | A1 * | 6/2016 | Chou | A63B 53/0466 473/350 |
| 2017/0312609 | A1 * | 11/2017 | Thornton | A63B 60/46 |
| 2018/0021652 | A1 * | 1/2018 | Du Plessis | A63B 69/36 |

* cited by examiner

*Primary Examiner* — John E Simms, Jr.
(74) *Attorney, Agent, or Firm* — Muncy, Geissler, Olds & Lowe, P.C.

(57) ABSTRACT

A golf club head includes a head unit, and an insertion unit including a housing body, an intelligent unit and an encapsulant. The housing body defines a receiving space, and has a base wall, a surrounding wall, an external thread for engaging an internal thread of the head unit, a recess formed in the base wall, and multiple hollow portions formed in and extending between the base wall and the surrounding wall. The intelligent unit is received in the receiving space, and includes a first circuit board, two charging electrodes disposed on the first circuit board, and a capacitor connected to the first circuit board and the charging electrodes. The encapsulant is received in the receiving space, partially covers the first circuit board, and exposes the charging electrodes.

7 Claims, 6 Drawing Sheets

GOLF CLUB HEAD

CROSS-REFERENCE TO RELATED APPLICATION

This application claims priority of Taiwanese Patent Application No. 106125443, filed on Jul. 28, 2017.

FIELD

The disclosure relates to a golf club head, and more particularly to a golf club head with intelligence and counterweight functions.

BACKGROUND

Golf has become increasingly popular as the standard of living has greatly improved over the years. More and more people play golf as hobby or even as competitive sport. In order to improve player performance, rigorous analysis of swing and hit data obtained from practice sessions is utilized to adjust the player's postures and strength, as well as the weight of the golf club.

Referring to FIG. 1, an intelligent golf club head 1 of a conventional golf club includes a main body 10 formed with an installation hole 100, and an intelligent counterweight unit 11 received in the installation hole 100. The intelligent counterweight unit 11 includes a coupling unit 111 positioned in the installation hole 100, an intelligent unit 112 disposed inside the coupling unit 111, and a cover 113 connecting to the intelligent unit 112 and closing the installation hole 100. The intelligent counterweight unit 11 can serve as a counterweight by its own weight, and the intelligent unit 112 can monitor and output numerous data generated during the swing and hit actions of the head unit 1, thus enabling the players to adjust their swing and hit actions based on the data output after being analyzed.

Further referring to FIG. 2, since the intelligent counterweight unit 11 is received in the main body 10, the impact on the main body 10 when the golf club head 1 hits a golf ball will be transmitted to the intelligent counterweight unit 11. The impact has a great influence on the intelligent unit 112, particularly in the case where the cover 113 is in direct contact with the intelligent unit 112, wherein the larger the contact area between the cover 113 and the intelligent unit 112 is, the greater the impact on the intelligent unit 112 is. Therefore, if the excessive impact generated during the golf club head 1 hitting the golf ball cannot be effectively dispersed, the intelligent unit 112 will be relatively susceptible to damage, thereby affecting the service life of the intelligent counterweight unit 11.

SUMMARY

Therefore, an object of the present disclosure is to provide a golf club head that can alleviate at least one of the drawbacks associated with the prior art.

According to the present disclosure, a golf head club includes a head unit and an insertion unit.

The head unit includes a main body, an installation hole formed in the main body, and an internal thread formed on an inner wall surface of the main body and defining the installation hole.

The insertion unit includes a housing body, an intelligent unit, and an encapsulant.

The housing body defines a receiving space having an opening, and has a base wall, a surrounding wall extending from a periphery of the base wall, a recess formed in the base wall and adapted to permit a tool to be engaged and rotated therein so as to rotate the housing body relative to the head unit, an external thread formed on an outer surface of the surrounding wall for threadedly engaging the internal thread of the head unit so that the insertion unit is detachably received in the installation hole, and a plurality of hollow portions formed in and extending between the base wall and the surrounding wall. The hollow portions and the receiving space are spatially communicated with each other.

The intelligent unit is received in the receiving space, and includes a first circuit board disposed in the opening of the receiving space, two charging electrodes disposed on the first circuit board, and a capacitor electrically connected to the first circuit board and the charging electrodes.

The encapsulant is received in the receiving space, at least partially covers the first circuit board of the intelligent unit, and fixes the intelligent unit in the receiving space. The charging electrodes are exposed from the encapsulant.

BRIEF DESCRIPTION OF THE DRAWINGS

Other features and advantages of the present disclosure will become apparent in the following detailed description of the embodiment with reference to the accompanying drawings, of which.

DETAILED DESCRIPTION

Figure 1:
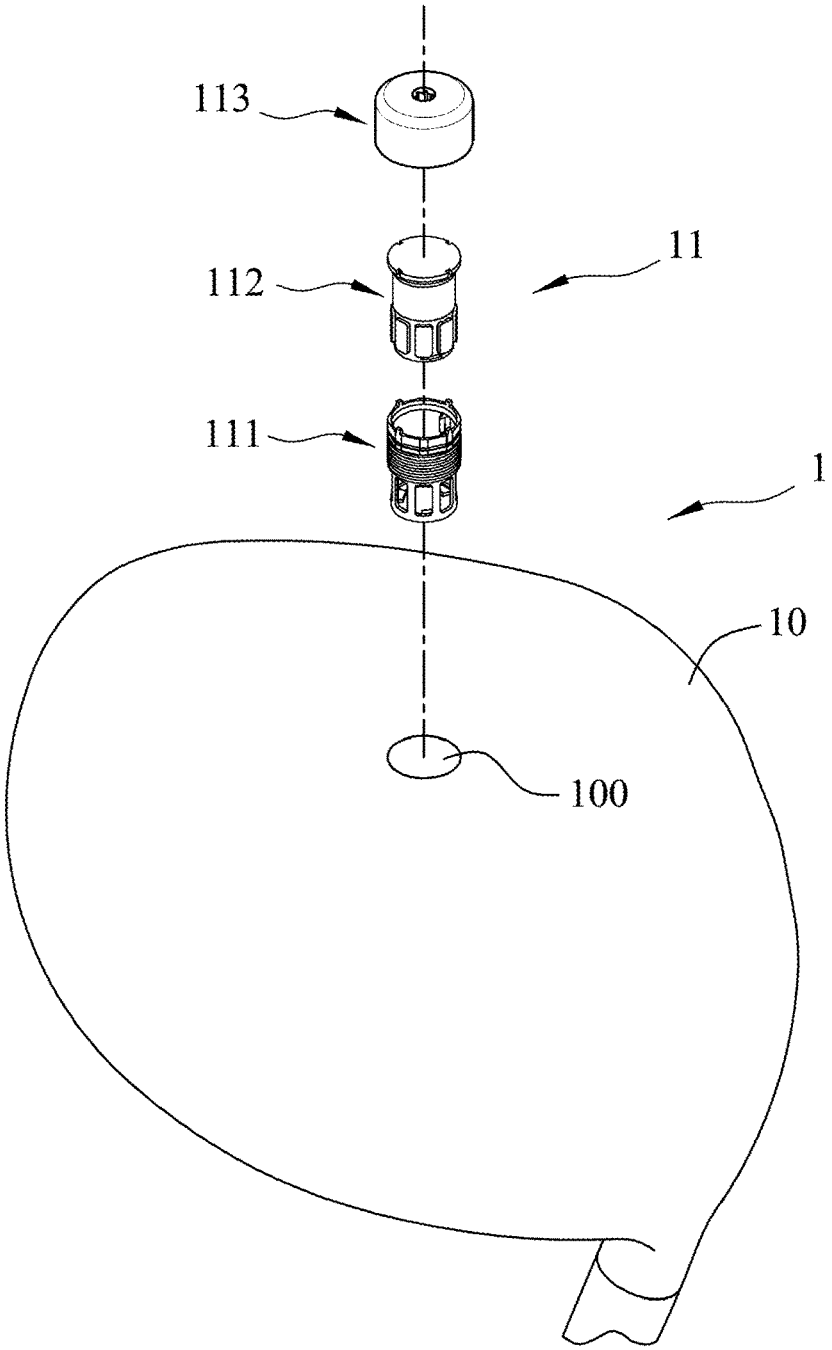
FIG.1 PRIOR ART
FIG. 1 is a fragmentary exploded perspective view of a conventional intelligent golf club.
Figure 2:
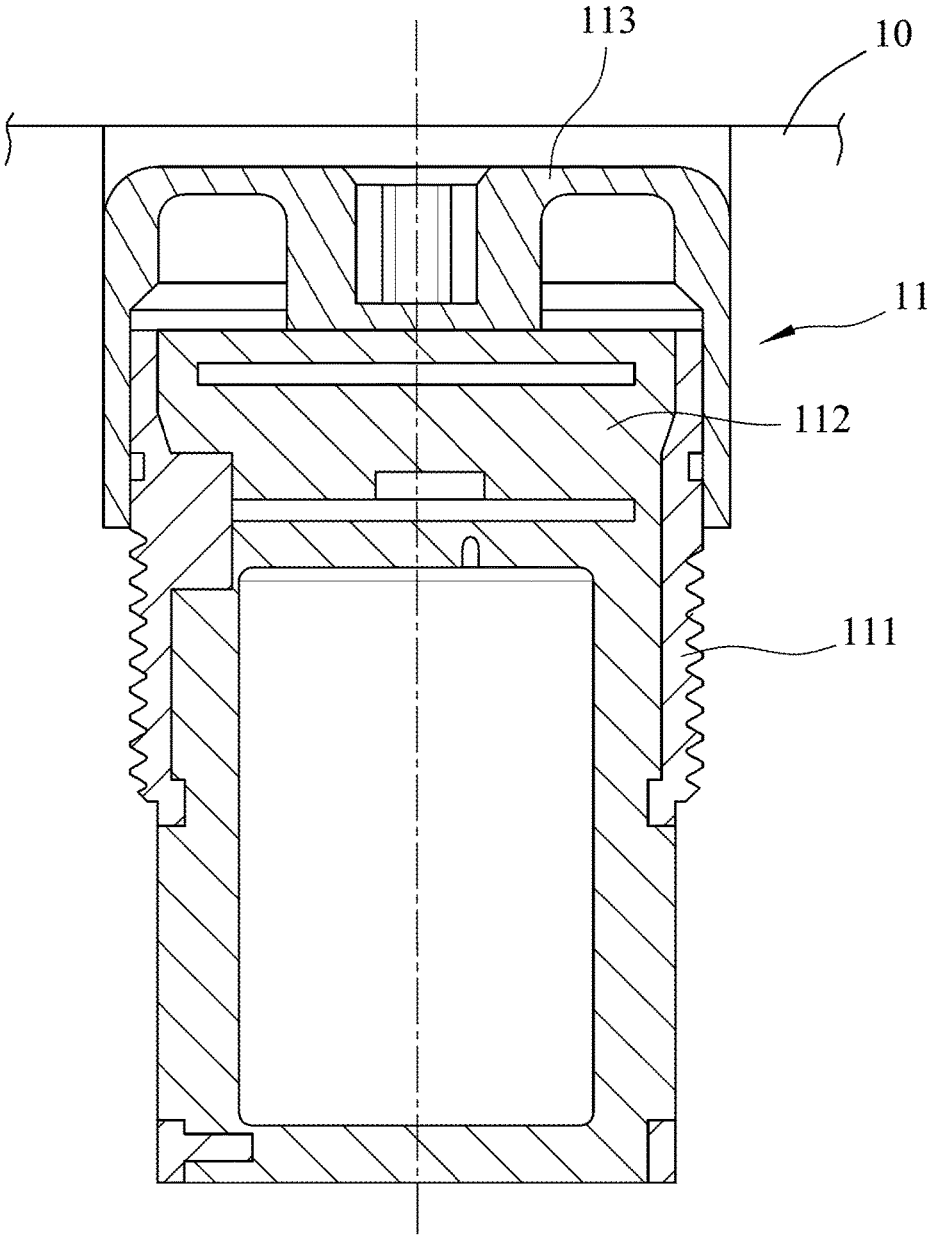
FIG.2 PRIOR ART
FIG. 2 is a fragmentary sectional view illustrating configuration of an intelligent counterweight unit within the conventional intelligent golf club.
Figure 3:
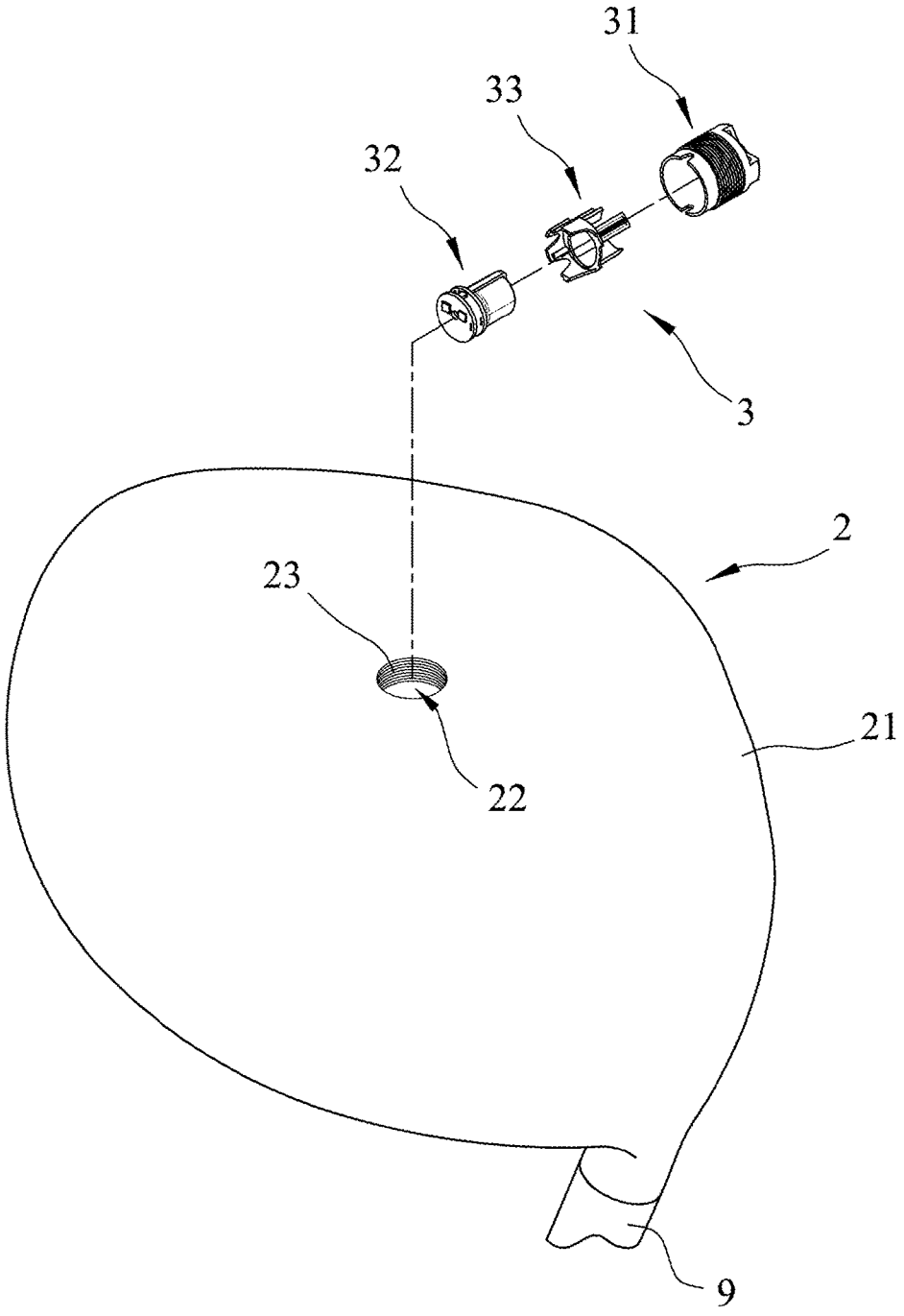
FIG. 3 is a fragmentary exploded perspective view showing an embodiment of the golf club head according to the present disclosure.
Figure 4:
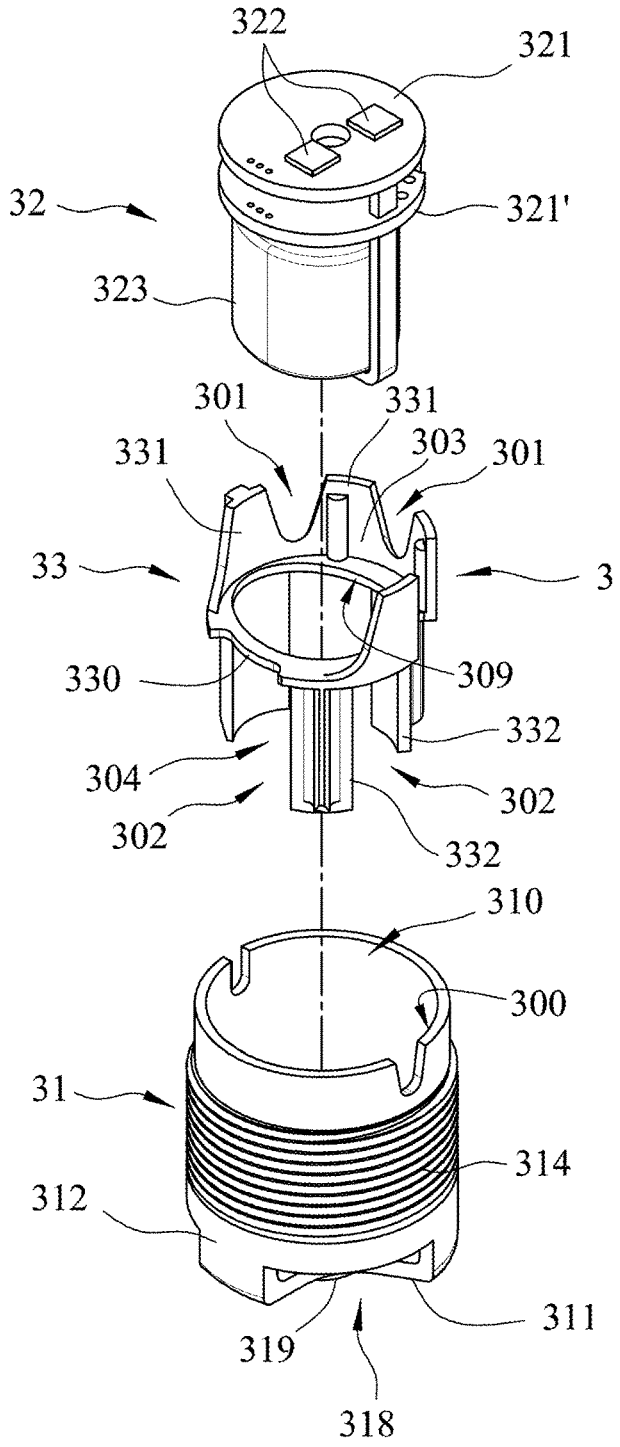
FIG. 4 is an exploded perspective view showing the insertion unit of the embodiment.
Figure 6:
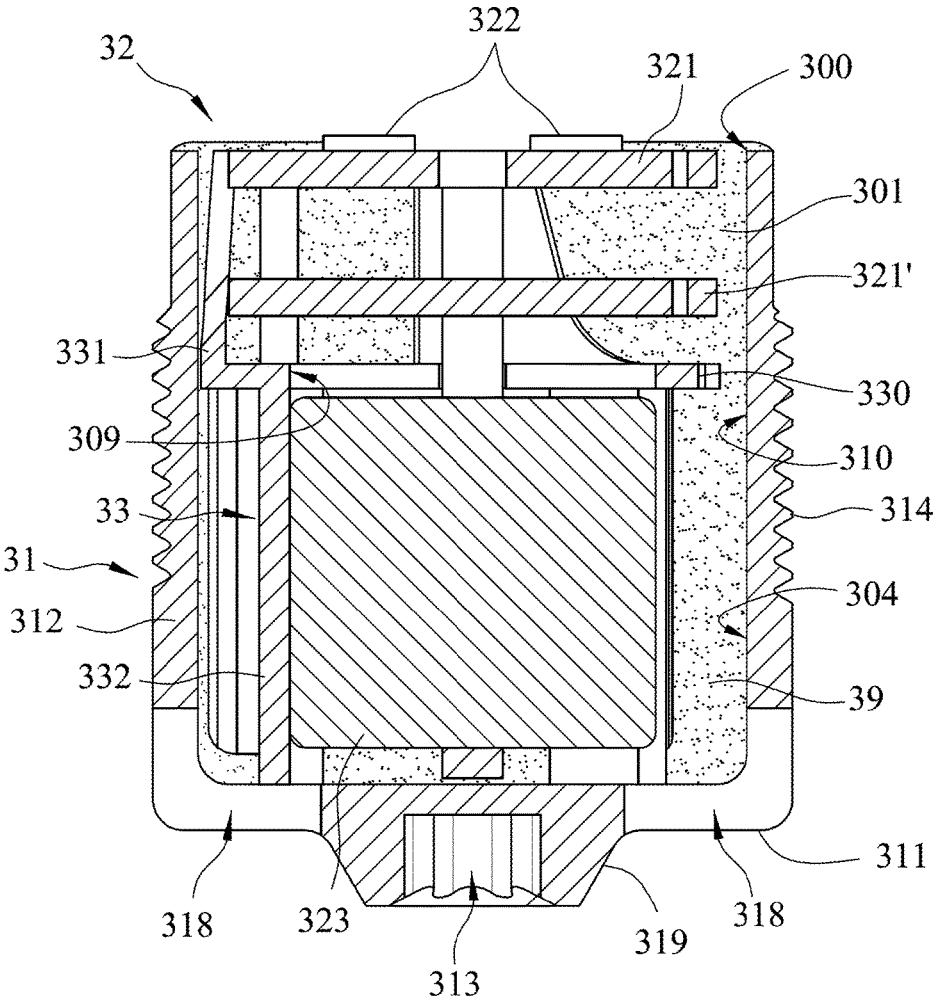
FIG. 6 is a sectional view of the insertion unit of the embodiment.

Referring to FIGS. 3, 4 and 6, an embodiment of a golf club head with intelligence and counterweight functions of the present disclosure includes a head unit 2 and an insertion unit 3. The head unit 2 is designed to be connected to a shaft 9 of a golf club.

The head unit 2 includes a main body 21, an installation hole 22 formed in the main body 21, and an internal thread 23 formed on an inner wall surface of the main body 21 and defining the installation hole 22. In this embodiment, the installation hole 22 is exemplified to be formed in a bottom surface of the main body 21 facing away from the shaft 9. However, the installation hole 22 may be formed in other positions of the main body 21 according to practical requirements.

The insertion unit 3 is detachably received in the installation hole 22, and includes a housing body 31, an intelligent unit 32, a holding unit 33, and an encapsulant 39.

Figure 5:
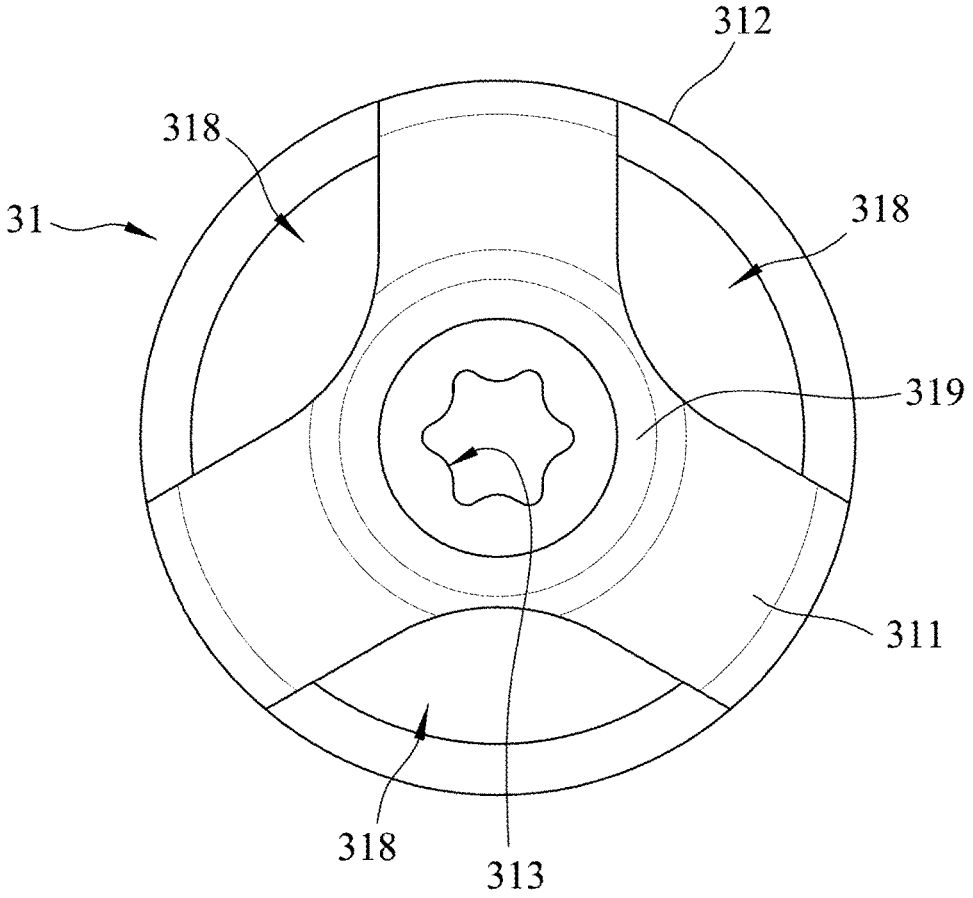
FIG. 5 is a bottom view of the insertion unit of the embodiment.

Further referring to FIG. 5 in combination with FIGS. 4 and 6, the housing body 31 defines a receiving space 310 having an opening 300, and has a base wall 311, a surrounding wall 312 extending from a periphery of the base wall 311, an external thread 314 formed on an outer surface of the surrounding wall 312 for threadedly engaging the internal thread 23 of the head unit 2, a recess 313 formed in the base wall 311 adapted to permit a tool (not shown) to be engaged and rotated therein so as to rotate the housing body 31 relative to the head unit 2, and a plurality of hollow portions 318 formed in and extending between the base wall 311 and the surrounding wall 312 and spatially communicated with the receiving space 310. The tool adapted to be engaged in the recess 313 may be a screw driver or other rotating tools of similar design, so as to rotate the housing body 31 relative to the head unit 2 for mounting the insertion unit 3 to the head unit 2 or dismantling the insertion unit 3 from the head unit 2. In the configuration of the insertion unit 3 received in the installation hole 22, the intelligent unit 32 and the holding unit 33 are received in the receiving space 310, and the intelligent unit 32 extends through and is fixed to the holding unit 33.

In this embodiment, the base wall 311 of the housing body 31 has a protrusion portion 319 that extends away from the receiving space 310. The hollow portions 318 are angularly spaced apart from each other and surrounding the protrusion portion 319 of the base wall 311. The recess 313 is formed in the protrusion portion 319.

The holding unit 33 has a base plate 330 that is formed with a through hole 309 through which the intelligent unit 32 extends, a plurality of first extending portions 331 that extend from the base plate 330 in a direction away from the base wall 311, and a plurality of second extending portions 332 that extend from the base plate 330 in a direction toward the base wall 311. Any two adjacent ones of the first extending portions 331 cooperatively define a first encapsulant-receiving space 301 therebetween. Any two adjacent ones of the second extending portions 332 cooperatively define a second encapsulant-receiving space 302 therebetween. The first extending portions 331 and the base plate 330 cooperatively define a board-receiving space 303. The second extending portions 332 and the base plate 330 cooperatively define a capacitor-receiving space 304.

The intelligent unit 32 includes a first circuit board 321, a second circuit board 321', two charging electrodes 322, and a capacitor 323. The first circuit board 321 is disposed in the opening 300 of the receiving space 310, and is received in the board-receiving space 303. The second circuit board 321' is spaced apart from the first circuit board 321 and is received in the board-receiving space 303. The charging electrodes 322 are disposed on a surface of the first circuit board 321 facing away from the second circuit board 321'. The capacitor 323 is received in the capacitor-receiving space 304, and is electrically connected to the first circuit board 321, the second circuit board 321' and the charging electrodes 322. In certain embodiments, other electronic components (not shown) may be provided on the first circuit board 321 for achieving the purpose of measuring and analyzing various data of the golf club head and a golf ball (not shown) hit by the golf club head during a player's swing and hit actions. When the insertion unit 3 is disassembled from the head unit 2, if necessary, the charging electrodes 322 may be electrically connected to an external power device (not shown) for providing electrical power to the capacitor 323 such that the electrical power is stored in the capacitor 323.

The encapsulant 39 is received in the receiving space 310, wherein the encapsulant 39 at least partially covers the first circuit board 321 of the intelligent unit 32, ensuring that the encapsulant 39 fixes the intelligent unit 32 disposed in the housing body 31. In addition, the charging electrodes 322 are exposed from the encapsulant 39, thus enabling an easy connection between the insertion unit 3 and the external power device after the insertion unit 3 is dismantled from the head unit 2. In this embodiment, a portion of the encapsulant 39 is filled in the first encapsulant-receiving spaces 301 defined by the first extending portions 331. Another portion of the encapsulant 39 is filled in the second encapsulant-receiving spaces 302 defined by the second extending portions 332.

Since the intelligent unit 32 is fixed to the holding unit 33 and disposed in the housing body 31, there is a gap with fixed distance between the intelligent unit 32 and the housing body 31, allowing the encapsulant 39 to fill the gap uniformly, and therefore sealing the intelligent unit 32 and the holding unit 33.

Since the insertion unit 3 itself has a weight, a desired counterweight effect can be achieved by mounting the insertion unit 3 on the head unit 2. The weight of the insertion unit 3 may be adjusted by changing the weight and the material of the holding unit 33, changing the density of the encapsulant 39, or even placing additional counterweight components (not shown) in the receiving space 310. The modularized insertion unit 3 is designed for the users to select the desired weight according to practical requirements, even to the extent of using a different sensor or processing circuit disposed on the first circuit board 321 of the intelligent unit 32, thereby enabling the adjustment of the sensing and analysis functions of the intelligent unit 32. The same module can be produced with a variety of different specifications according to the users' choice.

In practice, the golf club head of this disclosure is repeatedly subjected to the impact generated from striking the golf ball. A durability test was carried out by hitting the golf ball at a speed of 46 meters per second. The results demonstrated that the golf club head of this disclosure is capable of withstanding more than 3000 hits, with the intelligent unit 32 maintaining a normal function despite being repeatedly subjected to the impact. By designing a plurality of the hollow portions 318 that are angularly spaced apart from each other and the radial arrangement of the portion of the base wall 311 that physically contacts the intelligent unit 32, the contact area between the housing body 31 and the intelligent unit 32 is thus reduced to enable effective dispersion of the impact. In addition, encapsulation of this disclosure by the encapsulant 39 provides stability and impact resistance to the insertion unit 3.

In summary, the insertion unit 3 can be easily mounted or dismantled from the main body 21 of the head unit 2, and the module can be changed according to practical requirements. The counterweight function of the golf club head is achieved by the weight of the insertion unit 3 itself, and the intelligence sensing and analysis functions are performed by the intelligent unit 32. By designing a plurality of hollow portions 318 in the housing body 31, the impact generated from the hitting of the golf ball and transmitted to the intelligent unit 32 is reduced, therefore extending the service life of the intelligent unit 32.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A golf club head comprising:

a head unit including a main body, an installation hole formed in said main body, and an internal thread formed on an inner wall surface of said main body and defining said installation hole; and an insertion unit including a housing body that defines a receiving space having an opening, and that has a base wall, a surrounding wall extending from a periphery of said base wall, an external thread formed on an outer surface of said surrounding wall for threadedly engaging said internal thread of said head unit so that said insertion unit is detachably received in said installation hole, a recess formed in said base wall and adapted to permit a tool to be engaged and rotated therein so as to rotate said housing body relative to said head unit, and a plurality of hollow portions formed in and extending between said base wall and said surrounding wall and spatially communicated with said receiving space, an intelligent unit that is received in said receiving space, and that includes a first circuit board disposed in said opening of said receiving space, two charging electrodes disposed on said first circuit board, and a capacitor electrically connected to said first circuit board and said charging electrodes, and an encapsulant that is received in said receiving space, that at least partially covers said first circuit board of said intelligent unit, and that fixes said intelligent unit in said receiving space, said charging electrodes being exposed from said encapsulant.

2. The golf club head as claimed in claim 1, wherein said insertion unit further includes a holding unit that is received in said receiving space, said intelligent unit extending through and being fixed to said holding unit.

3. The golf club head as claimed in claim 2, wherein said holding unit has a base plate formed with a through hole through which said intelligent unit extends, a plurality of first extending portions extending from said base plate in a direction away from said base wall, and a plurality of second extending portions extending from said base plate in a direction toward said base wall, any two adjacent ones of said first extending portions cooperatively defining a first encapsulant-receiving space therebetween, in which a portion of said encapsulant is filled, any two adjacent ones of said second extending portions cooperatively defining a second encapsulant-receiving space therebetween, in which another portion of said encapsulant is filled, said first extending portions and said base plate cooperatively defining a board-receiving space that receives said first circuit board of said intelligent unit, said second extending portions and said base plate cooperatively defining a capacitor-receiving space that receives said capacitor of said intelligent unit.

4. The golf club head as claimed in claim 1, wherein said base wall of said housing body has a protrusion portion that extends away from said receiving space, said recess being formed in said protrusion portion.

5. The golf club head as claimed in claim 4, wherein said hollow portions surround said protrusion portion of said base wall.

6. The golf club head as claimed in claim 5, wherein said hollow portions are angularly spaced apart from each other.

7. The golf club head as claimed in claim 1, wherein said intelligent unit of said insertion unit further includes a second circuit board that is spaced apart from said first circuit board, said capacitor being further electrically connected to said second circuit board.

* * * * *